United States Patent [19]

Wilson

[11] Patent Number: 4,944,469

[45] Date of Patent: Jul. 31, 1990

[54] HIGH SPEED COILING APPARATUS

[75] Inventor: Thomas N. Wilson, Carrollton, Ga.

[73] Assignee: Southwire Company, Carrollton, Ga.

[21] Appl. No.: 290,949

[22] Filed: Dec. 28, 1988

[51] Int. Cl.[5] ..... B21C 47/14

[52] U.S. Cl. ..... 242/82

[58] Field of Search ..... 242/82, 83

[56] References Cited

U.S. PATENT DOCUMENTS

| | | | |
|---|---|---|---|
| 501,251 | 7/1893 | Kilmer | 242/82 |
| 2,997,249 | 8/1961 | Meinshavsen | 242/82 |
| 3,563,488 | 2/1971 | Bollig | 242/82 |
| 3,669,377 | 6/1972 | Gilvar et al. | 242/82 |
| 3,703,261 | 11/1972 | Cofer et al. | 242/83 X |
| 3,843,072 | 10/1974 | Rayfield | 242/82 |
| 4,353,513 | 10/1982 | Holthoff | 242/82 |

*Primary Examiner*—John M. Jillions

*Attorney, Agent, or Firm*—George C. Myers, Jr.; Stanley L. Tate

[57] ABSTRACT

In a continuous casting and rod rolling system, the production rate is generally limited by the capacity of the slowest element. The present invention is directed to changes in the rod coiling station portion of the system, and particularly to modifications to the flyer tube and loop forming portions which enable higher production capacity. According to these changes, the prior art flyer tube is shortened to eliminate the constant radius end portion thereof, and the circle forming function is performed by adding an annular cylinder coaxial with the flyer tube axis to shape the rod into a nearly perfect circle. The flyer tube according to the invention has a continuously changing angular relationship from its axis; the curved longitudinal path of the tube redirects rod from its vertical path to discharge the rod from the flyer tube in a generally horizontally direction. The circular loop forming cylinder forms the rod into circular loops which fall freely from the cylinder onto a turntable surface.

37 Claims, 4 Drawing Sheets

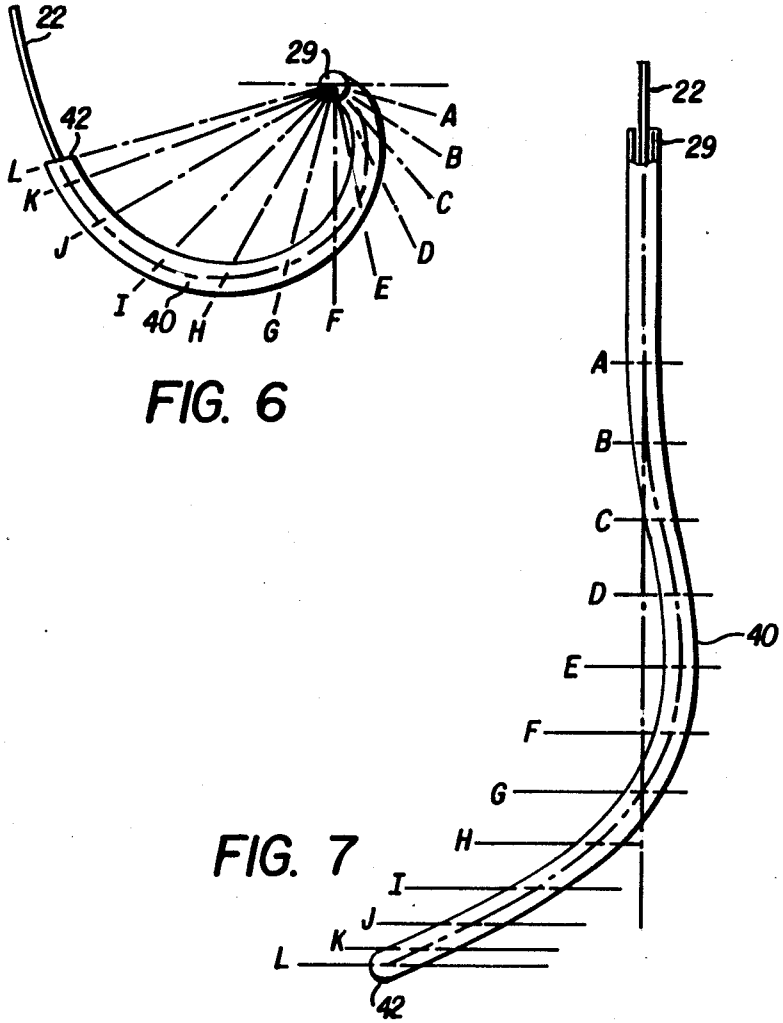
FIG. 7
FIG. 6
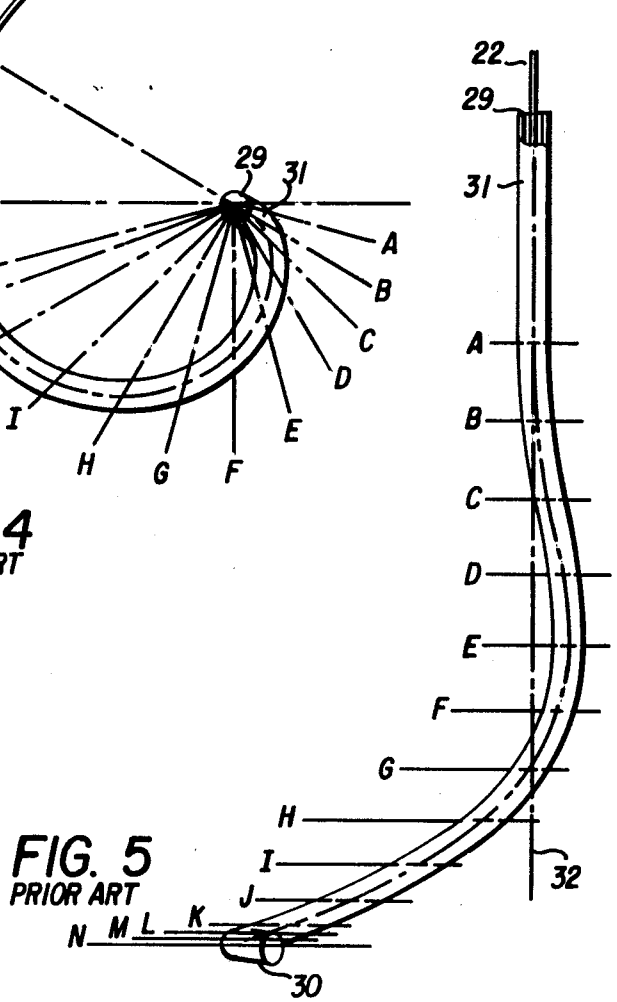
FIG. 5
PRIOR ART
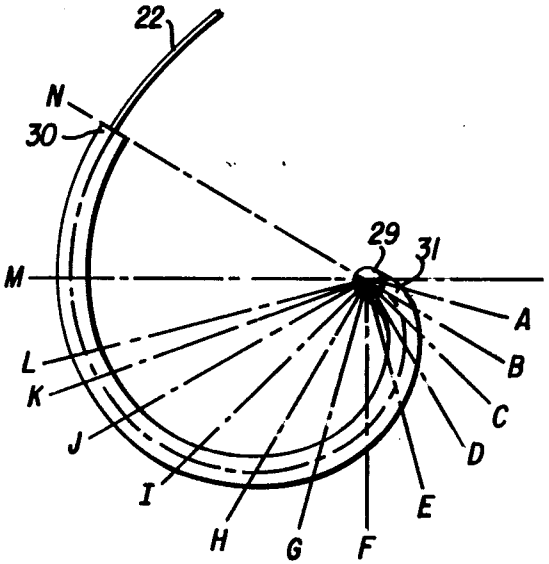
FIG. 4
PRIOR ART

HIGH SPEED COILING APPARATUS

BACKGROUND OF THE INVENTION

Non-ferrous continuous casting and rolling systems have been known for many years, and such systems for copper rod production are also well-known. These continuous rod production systems generally include apparatus for providing a continuous stream of molten metal to a casting machine in which the metal is solidified as a continuous cast bar, an in-line continuous rolling mill, an in-line rod cleaning apparatus, and a rod product coiling machine to collect the finished rod product for transport to further processing stations or for shipment.

The copper rod systems pioneered by The Southwire Company of Carrollton, Ga. USA initially produced copper rod at a production rate of about 10 tons per hour. The success of such systems is based on the economic advantages resulting from the continuous nature of the rod production and on the vastly improved copper rod product produced. Similar continuous systems are available for other non-ferrous products, such as aluminum and aluminum alloy rod, as well as for ferrous products. In the years since continuous copper rod was first achieved, the demand for further increased production economy based on greater throughput has driven the continuous casting technology to production rates of about 50 tons per hour or more. Because these manufacturing economies are available as a result of system improvements, production rate limitations of any of the system elements limits further economy of scale system improvements.

Coilers for coiling continuously produced metal rod and similar material have been developed for orbital coiling metal rod as it is initially and continuously discharged from a rolling mill or the like and for coiling the rod into a coil in which the loops are positioned so that the rod can be conveniently fed from the coil. The coil may also be packaged for transport for further processing. A well-known prior art orbital coiler is disclosed in U.S. Pat. No. 3,703,261, assigned to the assignee of the present invention.

The prior art orbital coiler produces epicyclic coils by the use of a turntable which rotates about a fixed axis of rotation and a flyer tube which rotates above the turntable about a substantially fixed axis of rotation that is displaced from the axis of rotation of the turntable. In the known prior art coiler, the flyer tube extends from an upper rod receiving end portion in the axis of rotation of the flyer tube above the coiling area and curves downwardly and outwardly to a lower rod discharge end portion having a constant radius. The discharge end moves in a circle about the axis of rotation of the flyer tube and is oriented so that metal rod passing into the receiving end exits the discharge end of the flyer tube and is formed into circular loops that drop to the rotating turntable.

In the prior art orbital coiler, the relationship between the diameter of the loops formed by the rotating flyer tube and the displacement of the axis of rotation of the flying tube relative to the axis of rotation of the turntable is such that each loop formed by the coiler includes within its circumference the axis of rotation of the turntable, which thus becomes the center line of the coil formed by the loops. The epicyclic displacement of successive loops relative to each other in a circular path around the turntable axis is a function of the rotational speed of the turntable and the linear speed of the metal rod as it passes through the flyer tube. The diameter of each loop may be varied by varying the angular speed of the discharge end of the flyer tube relative to the linear speed of the metal rod as it passes through the flyer tube. At a given operating speed, the constant radius portion of the flyer tube forms nearly perfect circular rod loops.

The prior art orbital coiler was originally designed to produce coils of large mass at a rate of approximately ten tons per hour and slightly more. As continuous casting and rolling of non-ferrous metals has increased from the lower production rate to substantially higher production rates, i.e., approximately fifty tons per hour and greater, it has been discovered that friction in the flyer tube portion of the coiler limits expansion of production capacity. For example, when producing 10 mm (⅜-inch) diameter copper rod at a rate of 60 tons per hour, rod entering the coiler is travelling in excess of 1800 meters per minute (6000 feet per minute), which is faster than the prior art flyer tube can readily accept without generating excess friction on the interior surfaces thereof. Friction, of course, increases with rod travel rate through the flyer tube and decreases with a decreasing flyer tube length.

Additionally, as the production rate increases, and particularly as the production rate increases above approximately forty tons per hour, the known flyer tube becomes subject to rapid wear and must be frequently replaced. The flyer tube is an expensive component part of the coiler, and its replacement necessitates interruption of the entire casting and rolling production process. It has also been discovered that simply reducing the length of the flyer tube to reduce excessive friction results in non circular or out-of-round loops which do not form into acceptable coils.

One function of the prior art flyer tube was to form the rod into circular loops. The lower discharge portion of the flyer tube was designed with a constant radius section such that metal rod to be coiled was fed into the receiving end of the flyer tube and was discharged from the discharge end of the flyer tube in the form of a continuous series of nearly perfect circular loops. The loops were simply permitted to drop to the surface of the turntable. The elongated, constant radius portion of the flyer tube functioned to limit the loop diameter and to maximize perfect circularity of the rod loops formed at a given production rate.

Shortening the flyer tube to reduce internal friction resulted in imperfect circular loops because the rod loop diameter was not well controlled. The imperfectly formed circular loops resulted in non-uniform coils of rod which are undesirable. This is true especially at the high loop forming speeds resulting from the higher production rates. Thus, while shortening the flyer tube does reduce friction in the flyer tube, it does not permit operation of the coiler at higher production rates because the coils formed at such higher production rates are unsatisfactory.

SUMMARY OF THE INVENTION

It is therefore an object of the present invention to improve the coiler rod-handling capability to permit increased production rates.

Another object of the present invention is increased operating wear life of coiler flyer tube.

Another object of the present invention is elimination of the maintenance cost and non-operating time costs associated with the frequent interruption of the production process to replace a worn flyer tube.

The advantages of the present invention include higher production rates, longer flyer tube wear life, fewer operating interruptions for flyer tube replacement, and therefore reduced rod manufacturing costs.

To overcome the difficulty of non-circular loops when a shortened flyer tube is used, an annular cylindrical containment ring or device is stationarily positioned in the approximate plane in which the rod exits the discharge end of the flyer tube in order to shape the rod into more perfectly formed circular loops. Rod is expelled from the flyer tube discharge end outward against an internal annular wall of the containment device such that there is substantially no relative movement between the wall and the rod being coiled, i.e., the velocity of the discharge end of the flyer tube is equal to rod velocity.

Thus, the present invention comprises a shortened and specially shaped spinning flyer pipe which directs a high speed rod product into a loop with low friction between the pipe and the rod. The spinning flyer tube directs the rod from an initial downward direction of rod travel along a spiral path to a substantially horizontal direction of rod travel. If the discharge end of the flyer tube is traveling at the same velocity as the rod but in the opposite direction, the resultant relative velocity between the rod and the stationary containment ring will be zero. Actual shaping of the rod into a circular loop is then accomplished by the stationary cylindrical ring extending slightly above and below the plane in which the rod loop is laid. The rod loops are directed against the inside wall of the cylindrical ring by the flyer tube. More perfectly shaped circular loops of rod are thus formed against the inside wall of the cylindrical ring and are permitted to fall by gravity from the ring onto the top of the rod coil being produced.

Because the cylindrical ring and the rod are both essentially stationary with respect to one another, little or no additional force is required to form the loop and the force required for feeding the rod into the pipe at high production rate speeds is greatly reduced because friction in the flyer pipe is minimized.

BRIEF DESCRIPTION OF THE DRAWINGS

For a further understanding of the nature and objects of the present invention, reference should be made to the following detailed description of the preferred embodiment taken in conjunction with the accompanying drawing figures in which like reference numerals identify like parts, wherein;

FIG. 4 is a top view of the known prior art flyer tube;

FIG. 5 is a side elevation view of the known prior art flyer tube;

FIG. 6 is a top view of the shortened, low friction flyer tube of the present invention;

FIG. 7 is a side elevation view of the shortened, low friction flyer tube of the present invention;

DETAILED DESCRIPTION OF A PREFERRED EMBODIMENT

Figure 1:
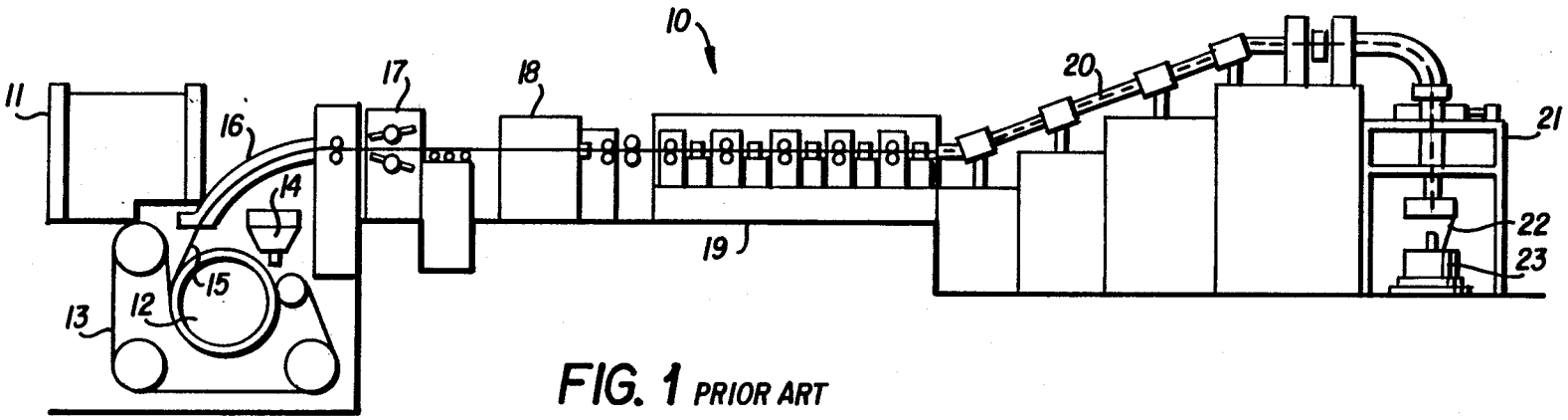
FIG. 1 PRIOR ART
FIG. 1 is a simplified elevation view of a conventional continuous casting and rolling system incorporating an orbital coiler.
Figure 2:
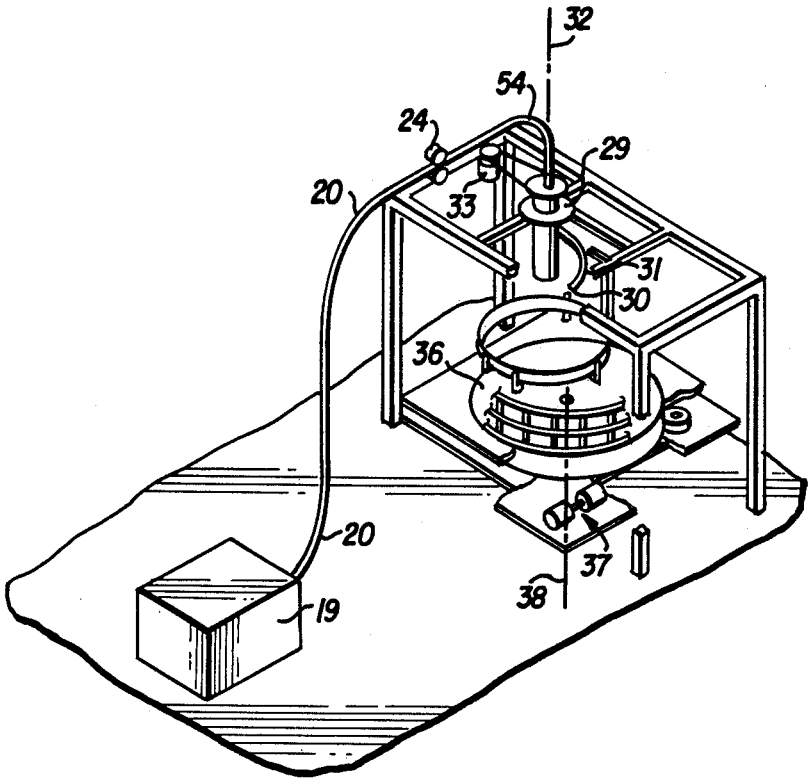
FIG. 2 PRIOR ART
FIG. 2 is a simplified perspective view of the known prior art coiler.
Figure 3:
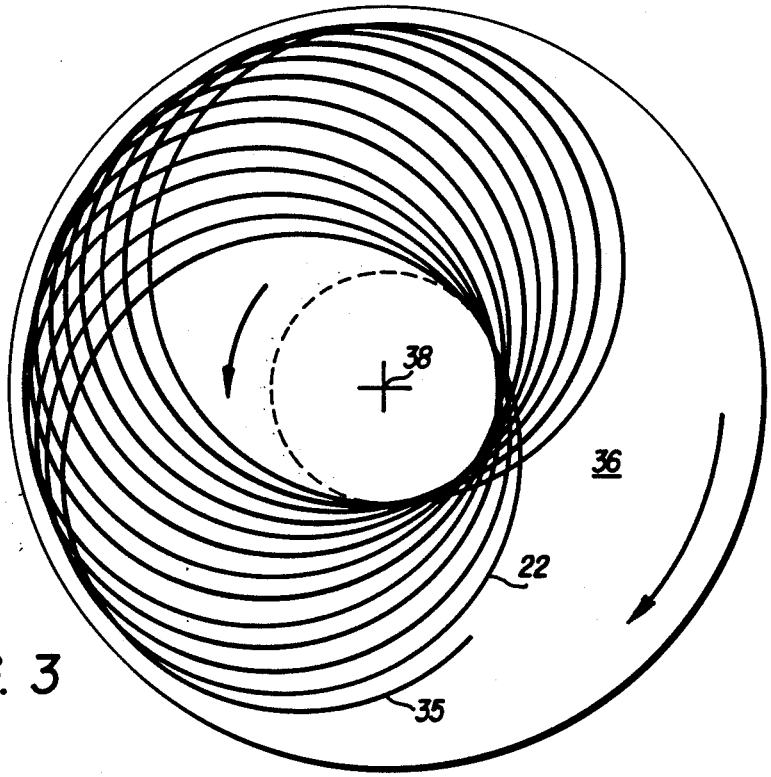
FIG. 3 is a simplified sketch of the coil laying pattern required to produce epicyclic coils of rod.

Referring to FIGS. 1 through 3, there is shown an example of a conventional continuous metal casting and rolling system 10, in which molten metal is supplied by a melting means 11 to a pouring means 14, poured into a moving mold formed by a peripheral groove in a rotating casting wheel 12 and casting band 13 which covers a portion of the casting wheel periphery to form a continuously advancing mold. Coolant, not shown, is applied to the closed portion of the moving mold to solidify the molten metal, forming a continuously cast bar 15, which is guided away from the casting machine by a cast bar conveyer 16 and directed to subsequent operations. A shear 17 may be used to sever sections of the cast bar 15, as may be required during ordinary manufacturing operations. The cast bar 15 may be routed through pre-rolling station 18 which may contain an initial bar treatment apparatus (not shown); the cast bar is then directed into rolling mill 19, in which a plurality of roll stations work the metal, reducing its cross section and elongating it to form a continuously advancing rod product 22. A delivery pipe 20, in which cooling, thermal and/or chemical treatments may be performed, guides the continuously cast and rolled rod 22 product into a coiler station 21, where the rod is collected into coils 23 for convenient handling and storage or shipping.

This system and process are well known, and are available from the Southwire Company, of Carrollton, Ga. U.S.A. Other continuous casting techniques are also known which are suitable for use with the present coiler invention.

A prior art coiler is shown in FIGS. 2 and 3. A rolling mill 19, producing a continuous rod 22 product directs the rod product to a pair of pinch rolls 24 via a pathway such as delivery pipe 20. From the pinch rolls 24, the rod 22 is directed via another pathway such as turndown feed tube 54 downward into the receiving end 29 of the flyer tube 31. Other rod guiding pathway apparatus, such as rollerized turndown 25 (see FIG. 8) may be substituted for feed tube 54.

As the rod 22 passes through prior art flyer tube 31, its direction of movement is changed from a substantially vertical path (along the broken line which is the axis 32 of rotation of the flyer tube 31) into a substantially horizontal arcuate path corresponding to the circle inscribed by motion of the constant radius discharge end 30 of the flyer tube about the axis 32 of rotation of the flyer tube.

According to U.S. Pat. No. 3,703,261, FIG. 1, the constant radius end portion of the prior art flyer tube 31 adjacent its discharge end 30 is oriented so that end 30 extends around substantially in a horizontal plane and such that the center of its constant radius of curvature generally coincides with the axis of rotation 32 of flyer tube 31. The constant radius discharge end of the prior art flyer tube is essential to the circular loop-forming function of that prior art flyer tube. A first driving means 33 may be used to rotate the prior art flyer tube 31 about the axis of rotation 32 of flyer tube 31 with the receiving end 29 of the flyer tube coincident with the axis of rotation 32 and the constant radius discharge end 30 of the prior art flyer tube 31 moving in a circle about the axis of rotation 32, substantially in a plane above the turntable 36. The constant radius discharge end portion of the prior art flyer tube serves to form the rod loops 35 (FIG. 3) into very nearly perfect circles. As the circular rod loops 35 are formed by rotation of the flyer tube, they fall to the surface of the turntable 36. Turntable 36 is rotated by a second drive means 37, in this example at a lower rotational speed, so the center of each successive loop is displaced from the center of the preceding loop along a circular epicyclic path having the turntable axis of rotation 38 at its center. This is best illustrated in FIG. 3 in which it can be seen that successive loops 35 overlap and that each circular loop 35 has a diameter which is such that the loop encloses within its circumference the axis of rotation 38 of turntable 36.

Turning now to FIGS. 4 and 5, there is shown the vertical displacement lines at points A through N on flyer tube 31 which correspond in the two views to show how the prior art flyer tube 31 curves down and around spirally from the vertical portion at the receiving end 29 to a constant radius portion between points L and N). As the prior art flyer tube 31 extends from point A to point L, the longitudinal path of the tube is redirected from a vertical direction to a substantially horizontal direction. When the continuously advancing rod product 22 passing through the flyer tube reaches point L it is traveling in an essentially constant radius, circular path in an essentially horizontal plane. Thus, rod 22 exits flyer tube 31 discharge end 30 and is deposited as a substantially perfect circular loop 35 onto turntable 36 (FIGS. 2 and 3).

Figure 8:
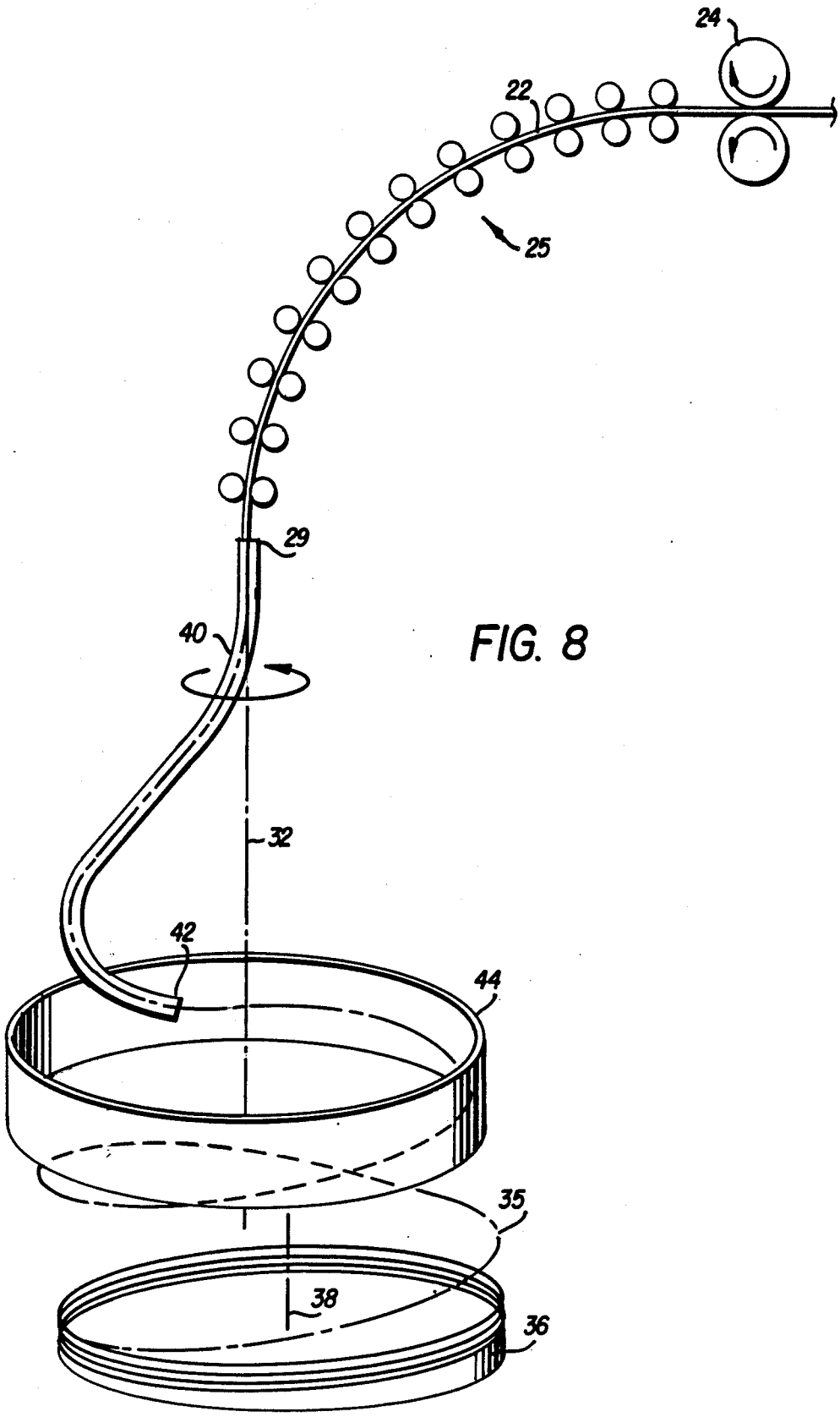
FIG. 8 illustrates the relationship of the coiler apparatus associated with the flyer tube and coil forming annular cylinder according to the present invention.

Turning initially to FIG. 8, a simplified version of the present invention is shown schematically, in which a continuously advancing rod product 22 is directed by pinch rolls 24 into a rollerized turndown 25 which redirects the rod along a downward path and into the upper end 29 of flyer tube 40, which rotates about the axis 32 of the downward path. Flyer tube 40 has a continuously changing radius about its axis of rotation 32. The curved longitudinal path of the tube redirects rod 22 from its vertically downward path and discharges the rod from end 42 of flyer tube 40 in a generally horizontal direction. Circular loop forming annular cylinder 44 restrains the rod 22 into circular loops 35 which fall freely from annular cylinder 44 onto the upper surface of a turntable 36. The outward force of the rod discharged from the end 42 of the flyer tube against the internal wall of the annular cylinder 44 may momentarily prevent the rod from falling to the turntable because of friction between the rod and cylinder as the loop is formed. The turntable 36 may have an axis of rotation 38 displaced from the axis 32 about which the flyer tube 40 rotates as in the prior art coiler arrangement shown in FIGS. 2 and 3.

In FIGS. 6 and 7, there is shown the flyer tube 40 of the present invention in the same views as FIGS. 4 and 5. Vertical displacement lines A through L on flyer tube 40 correspond in the two views to show how the longitudinal path of flyer tube 40 curves down and around in a curved, continuously changing radius from the initial entry point on the vertical axis. As the flyer tube 40 extends from point A to point L, the longitudinal path of the tube is redirected from a vertical direction to a substantially horizontal direction similar to the prior art flyer tube 31. However, in contrast to the prior art flyer tube 31, the rod 22 is not directed along a pathway wherein the rod passing therethrough travels along an essentially constant radius circular path when it exits discharge end 42. Rather, flyer tube 40 extends spirally outward along a constantly changing radius from point A to the discharge end 42 at point L.

Figure 9:
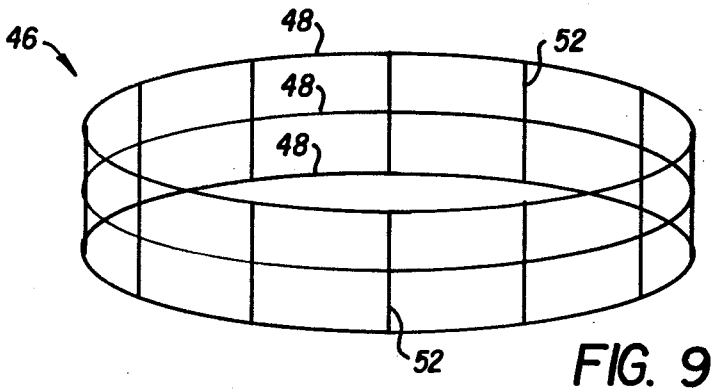
FIG. 9 is a perspective view of an alternative coil forming annular cylinder of the present invention.

A lightweight, alternative version of the coil forming cylinder is illustrated in FIG. 9. A skeletal, annular cylindrical frame 46 is formed of a plurality of straight vertical rib members 52 welded or otherwise affixed inside a plurality of circular horizontal rib members 48. The vertical ribs 48 are preferably equi-angularly spaced about the frame 46. Members 48 and 52 may be of solid material, or hollow to reduce weight without sacrificing strength.

Figure 10:
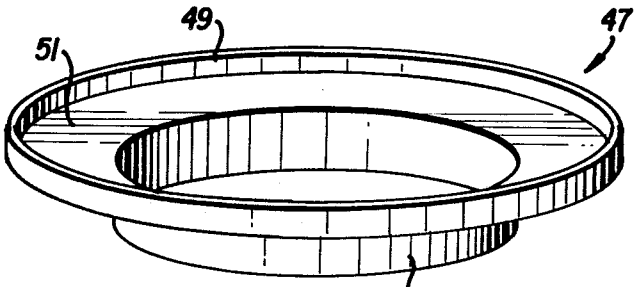
FIG. 10 is a perspective view of another alternative coil forming annular cylinder according the the present invention.

Another alternative embodiment of the annular coil-forming cylinder is illustrated in FIG. 10 which is useful for retrofitting the prior art coiler apparatus with the present invention. In the FIG. 10 alternative embodiment, upper first annular cylinder portion 49 and lower second annular cylinder portion 50 are joined by horizontal portion 51 and together form a stepped, two-diameter annular cylinder 47. The stepped, two-diameter cylinder 47 may be formed of skeletal members or of a solid wall portion, as shown, for example, in FIGS. 9 and 8, respectively. The internal wall of annular cylinder 50 is used to shape the coil loops and the annular cylindrical portion 49 is used for mounting.

While the present invention has been described in detail with particular reference to preferred embodiments thereof, it will be understood that variations and modifications can be effected within the spirit and scope of the invention as described above and as defined in the appended claims.

We claim:

1. A coiler for forming a continuous rod product into a coil having a plurality of circular loops, comprising:
   - means for directing the rod along a first path of travel having an axis;
   - flyer tube means having a rod entry end and a rod discharge end for receiving the rod and for diverting the rod from the first path of travel to a second path of travel at the rod discharge end substantially normal to the first path of travel;
   - means spaced from the discharge end of said flyer tube means for forming the rod into successive substantially circular loops of a predetermined radius, said loop forming means engaging the rod only at its radially outermost surface; and
   - means disposed downstream of said loop forming means for accumulating said successive circular loops.

2. The coiler of claim 1, wherein said flyer tube means has a curvature about the axis of the first path of travel from the rod entry end to the rod discharge end, the radius of said curvature continuously increasing from the rod entry end to the rod discharge end.

3. The coiler of claim 1, including means for rotatably mounting said flyer tube and means for rotation of said flyer tube about the axis of the first path of travel.

4. The coiler of claim 1, wherein said loop forming means comprises an annular ring disposed radially outwardly of the rod discharge end of the flyer tube means.

5. The coiler of claim 4, wherein said annular ring is stationarily mounted substantially concentric to the axis of rotation of the flyer tube means.

6. The coiler of claim 1, wherein the axis of the rod entry end of the flyer tube means is substantially coincident with the axis of the first path of travel and the axis of the rod discharge end is generally in a plane substantially normal to the axis of the first path of travel.

7. The coiler of claim 6, wherein the axis of the first path of travel is substantially vertical.

8. The coiler of claim 1, wherein the successive circular loops formed by the loop forming means have a common epicenter.

9. The coiler of claim 4, wherein said annular ring has an axial length, the discharge end of the flyer tube means being disposed in a plane intermediate the axial length and normal to the axis of the annular ring.

10. The coiler of claim 1, wherein said accumulating means comprise a turntable having an axis of rotation, and means for rotating said turntable about its axis of rotation.

11. The coiler of claim 10, wherein the successive circular loops formed by the loop forming means have a common epicenter displaced from the axis of rotation of the turntable.

12. The coiler of claim 1, wherein said flyer tube means comprises an elongated curved tube with a circular cross section.

13. A rotatable flyer tube for use in coiling a continuous rod product advancing along a path of travel having an axis comprising an elongated tube with a rod entry end and a rod discharge end, said tube having a circular cross-section and a curvature about said axis, the radius of curvature of said tube continuously increasing from the entry end to the discharge end thereof, the discharge end being oriented and rotatably driven such that the rod product exits said tube with a radially outward component of motion.

14. The rotatable flyer tube of claim 13, wherein the rod entry end and the rod discharge end are substantially normal to one another.

15. A coiler for an elongated rod product continuously advancing along a substantially downward path, comprising:

(a) flyer tube means for diverting the continuously advancing rod product from the substantially downward path to a generally horizontal path;

(b) means, spaced from said flyer tube diverting means, for forming the continuously advancing rod product into successive circular loops, said loop forming means engaging the rod product only at its radially outermost surface; and (c) support means, disposed below said loop forming means, for accumulating said successive circular loops.

16. The coiler of claim 15, wherein said flyer tube diverting means is rotatable about the downward path.

17. The coiler of claim 16, further including means for rotating said flyer tube diverting means about the substantially downward path.

18. The coiler of claim 15, wherein said flyer tube diverting means spirals outward from the substantially downward path to a generally horizontal path.

19. The coiler of claim 15, wherein said loop-forming means is a substantially annular cylinder.

20. The coiler of claim 15, wherein said loop-forming means confines the circular loops at least momentarily by frictional engagement between said elongated rod product and said loop-forming means.

21. The coiler of claim 15, wherein said loop-forming means is an annular shape having a continuous circular wall.

22. The coiler of claim 15, wherein said loop-forming means is a cylindrical shape having a discontinuous wall formed of vertically disposed members radially displaced around a central point.

23. The coiler of claim 15, wherein the support means comprises a rotatable table having an axis, and further includes means to rotate the table about the table axis.

24. The coiler of claim 15, wherein the circular loops have a common epicenter, the support means comprises a rotatable table having an axis, and the table axis is displaced from the epicenter of the circular loops.

25. The coiler of claim 15, wherein said flyer tube means for diverting includes a substantially vertical rod entry end and a generally horizontal rod discharge end, the circular loop- forming means extends above and below the rod forming means exit end, and the loop-forming means and the flyer tube diverting means have common axes.

26. For use in a coiler for coiling a continuously advancing elongated rod product advancing along a generally downward path, a rotatable flyer tube comprising an elongated tube having a circular cross section, said elongated tube having a longitudinal dimension beginning at an initial point along said path and having a substantially continuously changing radius along its longitudinal dimension, said flyer tube including entry end means for receiving said continuously advancing rod product at said initial point along said path and terminal discharge end means for directing said rod product in a generally horizontal direction, with a radially outward component of motion.

27. The flyer tube of claim 26, wherein said downward path includes a generally vertical initial path.

28. The flyer tube of claim 26, further including means for rotating said flyer tube about an axis formed by said downward path.

29. The method of coiling a rod product continuously advancing along a path which includes a generally downward direction, comprising the steps of receiving the continuously advancing rod product into a flyer tube, directing said rod product from its downward direction along a continuously changing radius within the flyer tube, discharging said continuously advancing rod product in a generally horizontal direction, and forming said continuously advancing rod product into generally circular loops by restraining said rod product only at its radially outermost surface at least momentarily in a fixed circular retainer.

30. The method of claim 29, further including the step of rotating the flyer tube about the axis of the downward vertical direction.

31. The method of claim 29, further including the step of accumulating said circular loops on a plane surface.

32. The method of claim 31, wherein the accumulating surface is a turntable, further including the step of rotating said turntable.

33. The method of claim 31, wherein the downward direction forms a first axis and the plane surface is a turntable, further including the step of rotating said turntable about a second axis which is parallel to said first axis.

34. The method of claim 33, wherein the first and second axes are both parallel and axially displaced, the step of forming an epicyclic coil by rotating said turntable about said second axis.

35. A coiler for forming a continuous rod product into a coil having a plurality of circular loops, comprising:

means for directing the rod along a first path of travel having an axis;

flyer tube means having a rod entry end and a rod discharge end for receiving the rod and for diverting the rod from the first path of travel to a second path of travel at the rod discharge end substantially normal to the first path of travel, said flyer tube means having a curvature about the axis of the first path of travel from the rod entry end to the rod discharge end, the radius of said curvature continuously increasing from the rod entry end to the rod discharge end;

means spaced from the discharge end of said flyer tube means for forming the rod into successive substantially circular loops of a predetermined radius, said loop forming means engaging the rod only at its radially outermost surface, said loop forming means comprising an annular ring disposed radially outwardly of the rod discharge end of the flyer tube means, said annular ring having an axial length, the discharge end of the flyer tube means disposed in a plane intermediate the axial length and normal to the axis of the annular ring; and means disposed downstream of said loop forming means for accumulating said successive circular loops.

36. The coiler of claim 35, wherein said annular ring has a continuous circular wall.

37. The coiler of claim 35, wherein said annular ring is a cylindrical shape having a discontinuous wall formed of vertically disposed members radially displaced about the axis of the annular ring.

* * * * *